US012595034B2

(12) United States Patent
Owen, III

(10) Patent No.: US 12,595,034 B2
(45) Date of Patent: Apr. 7, 2026

(54) VARIABLE ANGLE RUDDER LIFT ACTUATION DEVICE

(71) Applicant: Miller W. Owen, III, Panama City, FL (US)

(72) Inventor: Miller W. Owen, III, Panama City, FL (US)

( * ) Notice: Subject to any disclaimer, the term of this patent is extended or adjusted under 35 U.S.C. 154(b) by 644 days.

(21) Appl. No.: 17/959,631

(22) Filed: Oct. 4, 2022

(65) Prior Publication Data

US 2023/0104703 A1 Apr. 6, 2023

Related U.S. Application Data

(60) Provisional application No. 63/252,217, filed on Oct. 5, 2021.

(51) Int. Cl.
*B63H 11/113* (2006.01)
*B63H 25/38* (2006.01)

(52) U.S. Cl.
CPC ..... *B63H 11/113* (2013.01); *B63H 25/382* (2013.01)

(58) Field of Classification Search
CPC ..... B63H 11/04; B63H 11/10; B63H 11/107; B63H 11/11; B63H 11/113; B63H 11/117; B63H 25/06; B63H 25/42; B63H 11/382
USPC ..... 440/40, 42
See application file for complete search history.

(56) References Cited

U.S. PATENT DOCUMENTS 3,187,708 A * 6/1965 Fox ..... B63H 11/117 440/46
3,302,605 A * 2/1967 Kuether ..... B63H 11/113 440/46
3,624,737 A * 11/1971 Keller ..... B63H 11/113 60/221
3,680,315 A * 8/1972 Aschauer ..... B63H 11/04 60/221
3,782,320 A * 1/1974 Groves, Jr. ..... B63H 11/11 440/41
3,827,390 A * 8/1974 De Vault ..... B63H 11/11 60/221
5,123,867 A * 6/1992 Broinowski ..... B63H 11/08 440/38
5,460,553 A * 10/1995 Craig ..... B63H 11/04 440/89 R
6,676,462 B2 * 1/2004 Yanagihara ..... B63H 11/11 440/41

* cited by examiner

*Primary Examiner* — Daniel V Venne
(74) *Attorney, Agent, or Firm* — Adrienne Love

(57) ABSTRACT

A device for improving steering in a watercraft. The device has a frame attached to two parallel blades. The device pivotally attaches to an attachment point on a steerable nozzle of a watercraft. Frame of device has two curved mount brackets that are substantially parallel to one another having a first end and second end. A mount bracket connector connects the two mount brackets at the first end. The mount bracket connector includes a down force regulator, that folds back over mount bracket connector. Each mount bracket terminates at its second end with a lift tab. Lift tabs direct water flow in a generally downward and outward direction as watercraft moves through the water. Each mount bracket bolts to a blade, thereby holding the two blades securely parallel to one another.

20 Claims, 16 Drawing Sheets

VARIABLE ANGLE RUDDER LIFT ACTUATION DEVICE

CROSS-REFERENCES TO RELATED APPLICATIONS

Pursuant to the provisions of 37 C.F.R. § 119(e), this non-provisional application claims the benefit of an earlier-filed provisional patent application. The earlier application was assigned U.S. Ser. No. 63/252,217 and has the same inventor.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of devices made for steering a watercraft. More specifically, the invention relates to a mechanism which actuates a rudder system into and out of the stream of water beneath the watercraft.

2. Description of the Related Art

A water-jet driven craft's primary means of steering is achieved by directing the flow of a water jet propulsion system's water jet stream. Water jet propulsion vessels are popular for recreational watercrafts. A prior art watercraft 30 is illustrated in FIG. 1. These crafts are typically propelled by two or four stroke gasoline engines in connection with an impeller housed in a tubular chamber, the forward end of which draws in the water and the rearward end which expels it to provide thrust via the jet stream 40 to propel the craft or vessel. In most instances, a tubular nozzle 34 is attached to the discharge end which pivots from side to side in sync with the steering control 44 to provide steering capability. As the tubular nozzle 34 pivots the jet stream 40 is redirected along a horizontal plane (sideward deviation).

A detailed view of a prior art jet propulsion system is shown in FIG. 2. The pump assembly 50 includes the tubular chamber (impeller housing 52) and the impeller duct, which draws in the water. The watercraft moves forward by expelling water out of nozzle outlet 38 of tubular nozzle 34. The tubular nozzle 34 pivots in sync with the steering control 36 allowing the forward steering of the watercraft. A reverse gate 36 is pivotably attached to tubular nozzle 34. Tubular nozzle 34 has a nozzle outlet 38 and a reverse outlet 42, as shown in FIG. 3. When reverse gate 36 is in an open position (as shown in FIGS. 2 and 3) jet stream expels water out of nozzle outlet 38 in a substantially horizontal plane. When reverse gate 36 is a closed position covering nozzle outlet 38) jet stream is redirected out of reverse outlet 42. In a closed position reverse gate 32 diverts jet stream downward and slightly towards the back of the boat to allow the boat to slow, stop and/or drive the boat n reverse. Thus, the reverse gate 36 can redirect the jet stream 40 such that the jet stream 40 provides a rearward force on the watercraft.

Without further modification, the directional change of a water-jet driven craft is directly proportional to the force and volumetric flow rate provided by the thrust of the water jet propulsion system. At slow or idle speed, this force is minimal, resulting in sluggish steering response, which reduces control of the watercraft when idling, docking or in the vicinity of another watercraft. The reduction or minimal ability to control the vessel reduces the capability of the operator to safely maneuver the craft and has been responsible for numerous accidents. Because most of the vessels are not equipped with any type of braking system, it is imperative that the operator always be in control of the vessel, no matter the speed.

Prior art solutions to this issue, include providing an auxiliary appendage 54 to improve off-plane steering, craft maneuverability and reactionary turning radius, as shown in FIGS. 4 and 5. Prior art auxiliary appendages 54 include two rudder blades attached to the steerable nozzle 34, such that rudder blades directionally control the watercraft by pivoting with the steerable nozzle of the watercraft. Although prior art auxiliary appendages pull rudder blades out of the water at increasing speeds, the prior art solutions use a deflection bar (actuator) 56 that interacts with the jet stream (or jet thrust) to actuate the rudder blades out of the water. The prior art deflection bar actuator 56 is angled so that the upward force of the jet stream 40 will cause deflection bar (actuator) 56 to quickly move upward through jet stream 40. Deflection bar (actuator) pulls rudder blades out of the water and rides along the top of the jet stream 40, as shown in FIGS. 4 and 5. As the torsion spring pulls the blades downward, the deflection bar (actuator) 56 continues to interact with the top of the jet stream 40, even at high speeds. Therefore, the use of the prior art deflection bar (actuator) 56 causes interference with the top of the jet stream, resulting in unwanted spray and wear and tear on the component parts.

What is needed is a more effective actuator to lift the blades upward by utilizing the water flow beneath the watercraft, rather than the jet stream. The present invention achieves the objective of providing lift to the rudder blades based on the interaction with the waterflow flowing beneath the boat. The device has additional advantages further discussed herein.

BRIEF SUMMARY OF THE INVENTION

A device for improving steering in a watercraft. The device has a frame attached to two parallel blades. The device pivotally attaches to an attachment point on a steerable nozzle of a watercraft. Two devices can be used for a twin-engine watercraft.

Frame of device has two curved mount brackets that are substantially parallel to one another having a first end and second end. A mount bracket connector connects the two mount brackets at the first end. The mount bracket connector includes a down force regulator, that folds back over mount bracket connector. Each mount bracket terminates at its second end with a lift tab. The crease where lift tab connects to mount bracket is substantially parallel to the back edge of the blades, however, as the main body of lift tab extends away from mount bracket it is angled downward, such that the angular displacement between mount bracket and lift tab (along crease) is greater than 90 degrees. It is in this manner that lift tab directs water flow in a generally downward and outward direction as watercraft moves through the water. Each mount bracket bolts to a blade, thereby holding the two blades securely parallel to one another.

As a watercraft moves through a body of water, the flow of the water affects device. At low speeds, device stays in a lower position because of the downward torque acting on blades and the down force regulator which rides along the bottom of the jet stream (i.e. jet stream forces down force regulator downward thereby maintaining blades in lower position at lower speeds). This lower position allows for greater control over the steering of the watercraft. As the watercraft increases its speed through the water, the water flow beneath and around the watercraft, impacts the lift tabs on the device. The lift tabs push water downward and outward, thereby moving lift tabs (and device) upward through the water. Lift tabs are set wide enough apart so as not to interact with the jet stream when pivoting out of the body of water. As the speed increases the upward force on the lift tabs increases causing blades to pivot out of the body of water. Lift tabs continue to maintain lift as watercraft maintains its speed. In its raised position, lift tabs lift mount bracket connector above flow of jet stream, thereby eliminating any potential spray caused by any of the component parts of device interacting with the jet stream exiting the steerable nozzle.

The present invention allows the blades of device to be easily lifted and lowered into the body of water without causing unwanted spray for a surfer behind the watercraft. It creates an easy and efficient mechanism for actuating the blades without use of the force created by the jet stream. These and other features, aspects, and advantages of the present device will become better understood with reference to the following description and accompanying drawings.

The term "and/or," as used in this disclosure, is inclusive of the items which it joins linguistically, and each item by itself. Any object described can be as described or "substantially" as such wherein "substantially" is defined as "at least 95% true" or "at least 95% of the angular displacement described."

REFERENCE NUMERALS IN THE DRAWINGS

Figure 1:
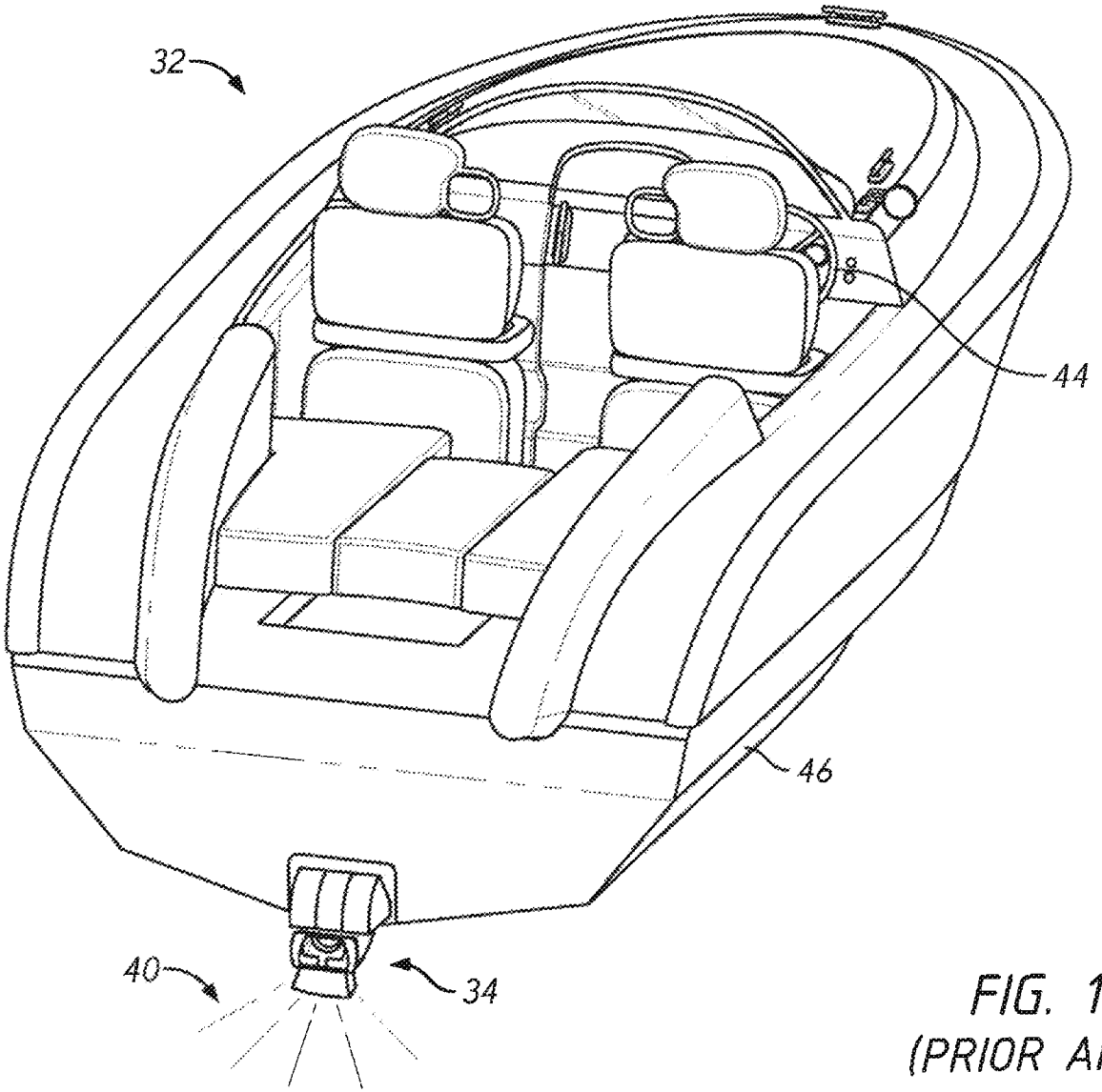
FIG. 1 (PRIOR ART)
FIG. 1 is a perspective view, showing a prior art watercraft.

10 device
12 blade
14 down force regulator
16 mount bracket connector
18 cross tie
20 frame
77 lift tab
24 mount bracket
26 attachment point
28 mount holes
30 kickstand
32 watercraft
34 steerable nozzle
36 reverse gate
38 nozzle outlet
40 jet stream
42 reverse outlet
44 steering control (wheel)
46 hull
48 nozzle discharge
50 pump assembly
52 impeller housing
54 prior art auxiliary appendage
56 prior art deflection bar
58 threaded hole
60 bolts
62 washers
64 threaded bolt
66 torsion spring
68 displaced water flow
70 back edge of blade
72 surface of body of water
74 kickstand body
76 screw
78 spacer
80 spring
82 spring hole
84 steering arm
86 crease

DETAILED DESCRIPTION OF THE INVENTION

Figure 6:
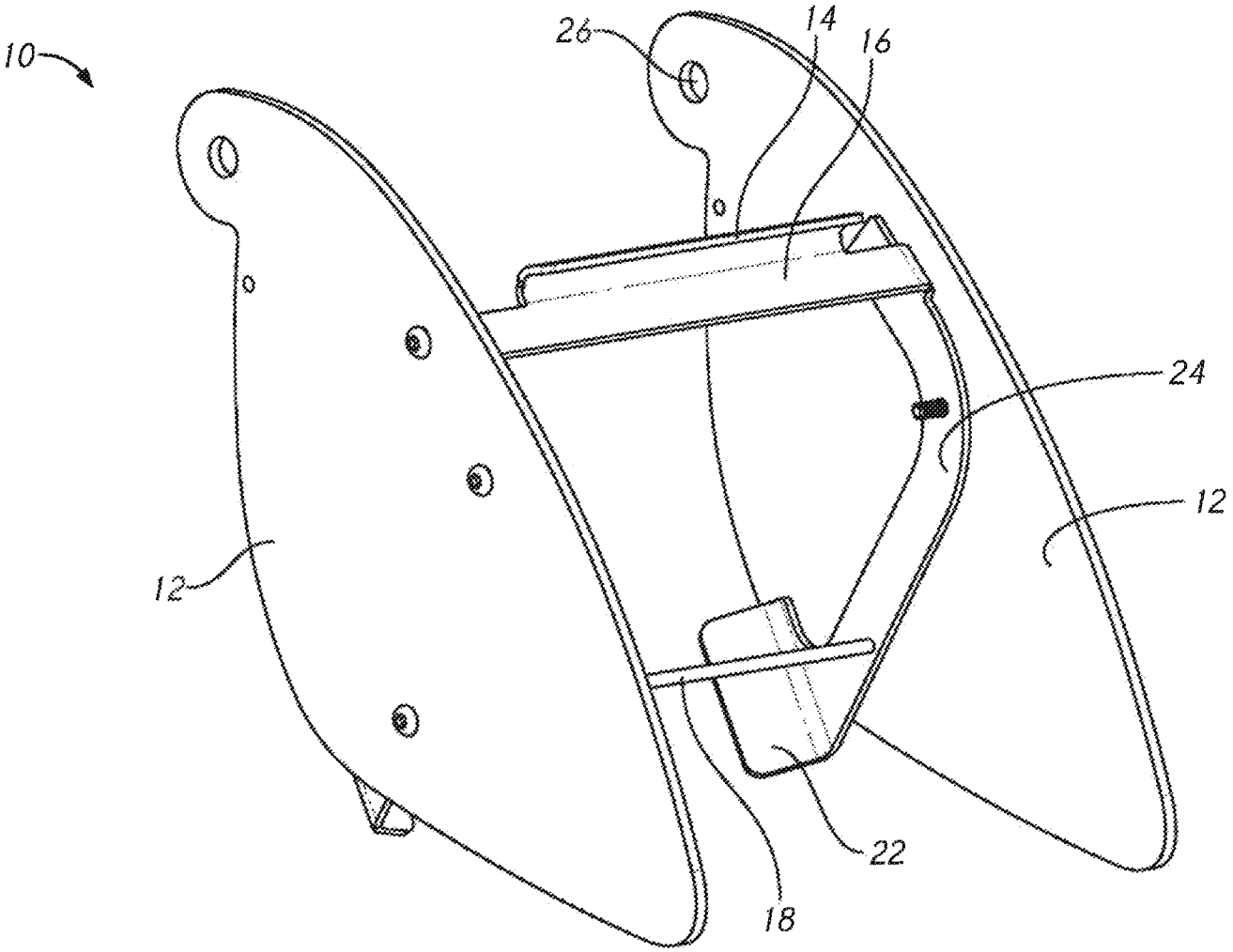
FIG. 6 is a perspective view, showing the present device.

The present device 10 is shown in FIG. 6. The device 10 can redirect the flow of the jet stream exiting the nozzle outlet 38 (shown in FIG. 2). Although one device 10 is shown that can be attached to a single engine boat, two devices 10 can be utilized on a twin-engine boat.

Figure 7:
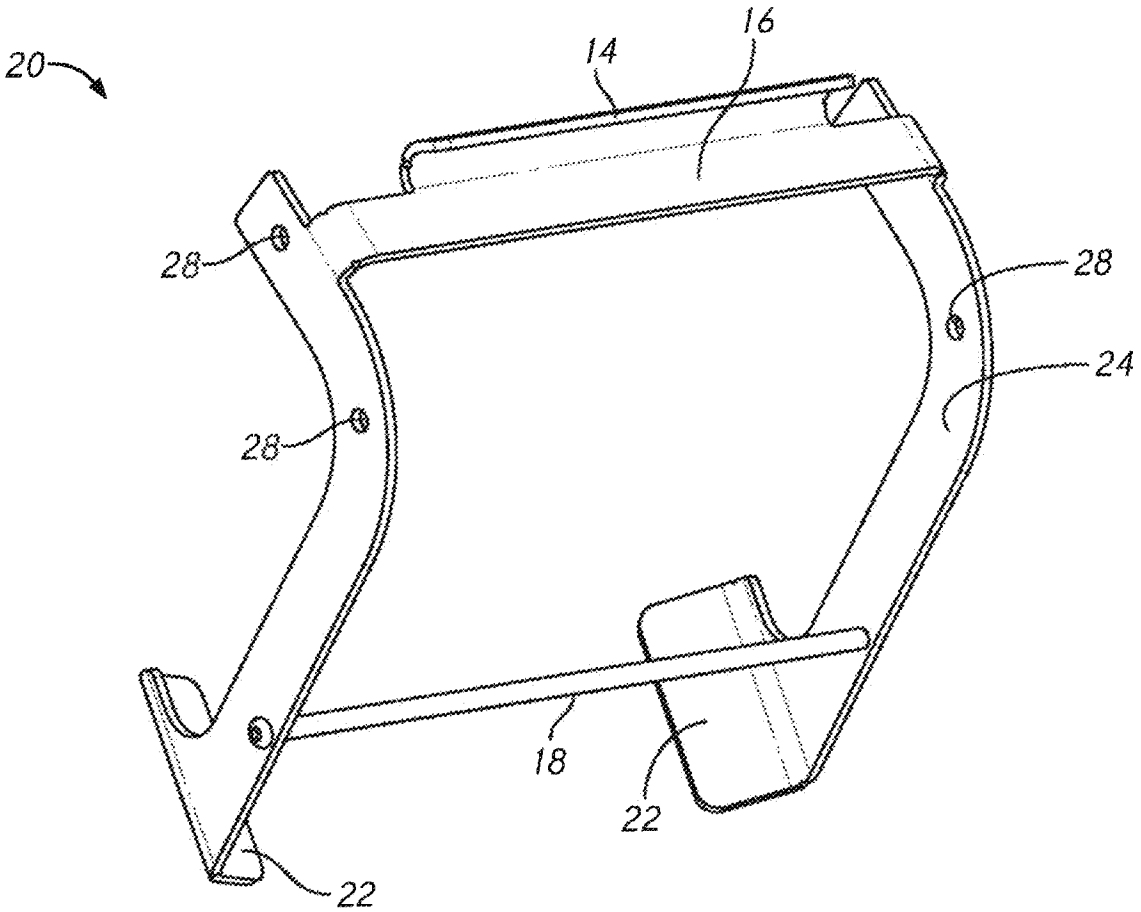
FIG. 7 is a perspective view, showing a component part of the present device.

Device 10 is generally comprised of two blades 12 and a frame 20 (shown as a component part in FIG. 7). Frame 20 has a mount bracket connector 16, a cross tie 18, two mount brackets 24 and two lift tabs 22. The two blades 12 are fixedly connected to one another by frame 20, which provides stabilization, structural integrity, and maintains a set distance between blades 12 without interfering with the movement or functionality of device 10. Blades 12 are nearly mirror images of one another with several holes for engagement of frame 20 in each blade 12. Mount bracket connector 16 includes a down force regulator 14.

Frame 20, shown in FIG. 7, has two mount brackets 24, substantially parallel to one another and curved in shape (in one embodiment substantially a C-shape). Two mount brackets 24 are connected by a mount bracket connector 16 on their first end and a cross tie 18 proximate their second end. Two lift tabs 22 are integrated into the second (terminal) end of each mount bracket 24, below cross tie 18. Mount bracket connector 16 includes a down force regulator 14 that interacts with the lower portion of jet stream to regulate down forces applied by jet stream exiting the prior art nozzle 34 (as further described herein). Frame 20 can be fabricated as one integrated unit. In one example, a stainless-steel one piece laser cut sheet metal part can be used to form frame 20. Each mount bracket 24 includes a series of mount holes 28 to connect frame 20 to blades 12.

Figure 8:
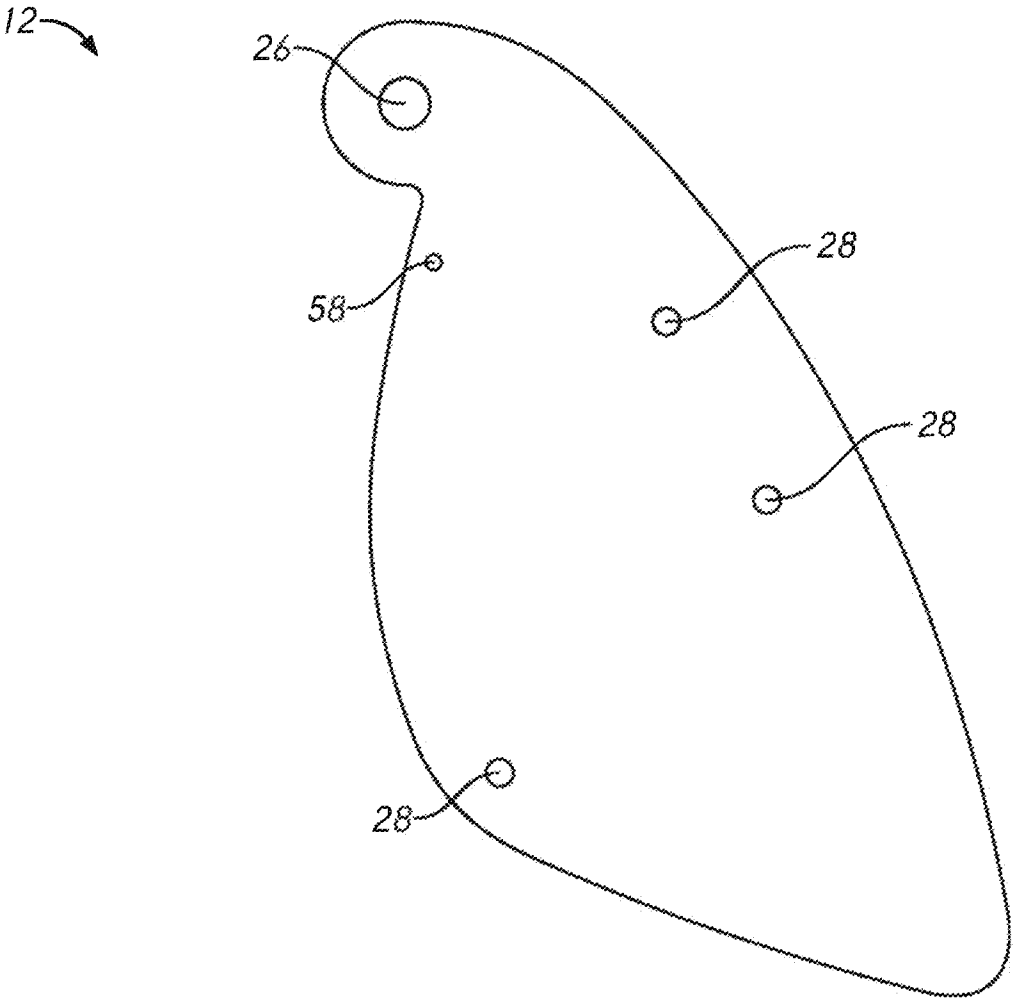
FIG. 8 is a perspective view, showing a component part of the present device.

FIG. 8 is an isolated view of blade 12. Blade 12 includes an attachment point 26 and mount holes 28. Blade 12 optionally includes a small hole 58 that can accommodate a kickstand mechanism 30 (illustrated in FIGS. 14-16). Blades 12 are preferably made of a durable polymer material.

Figure 9:
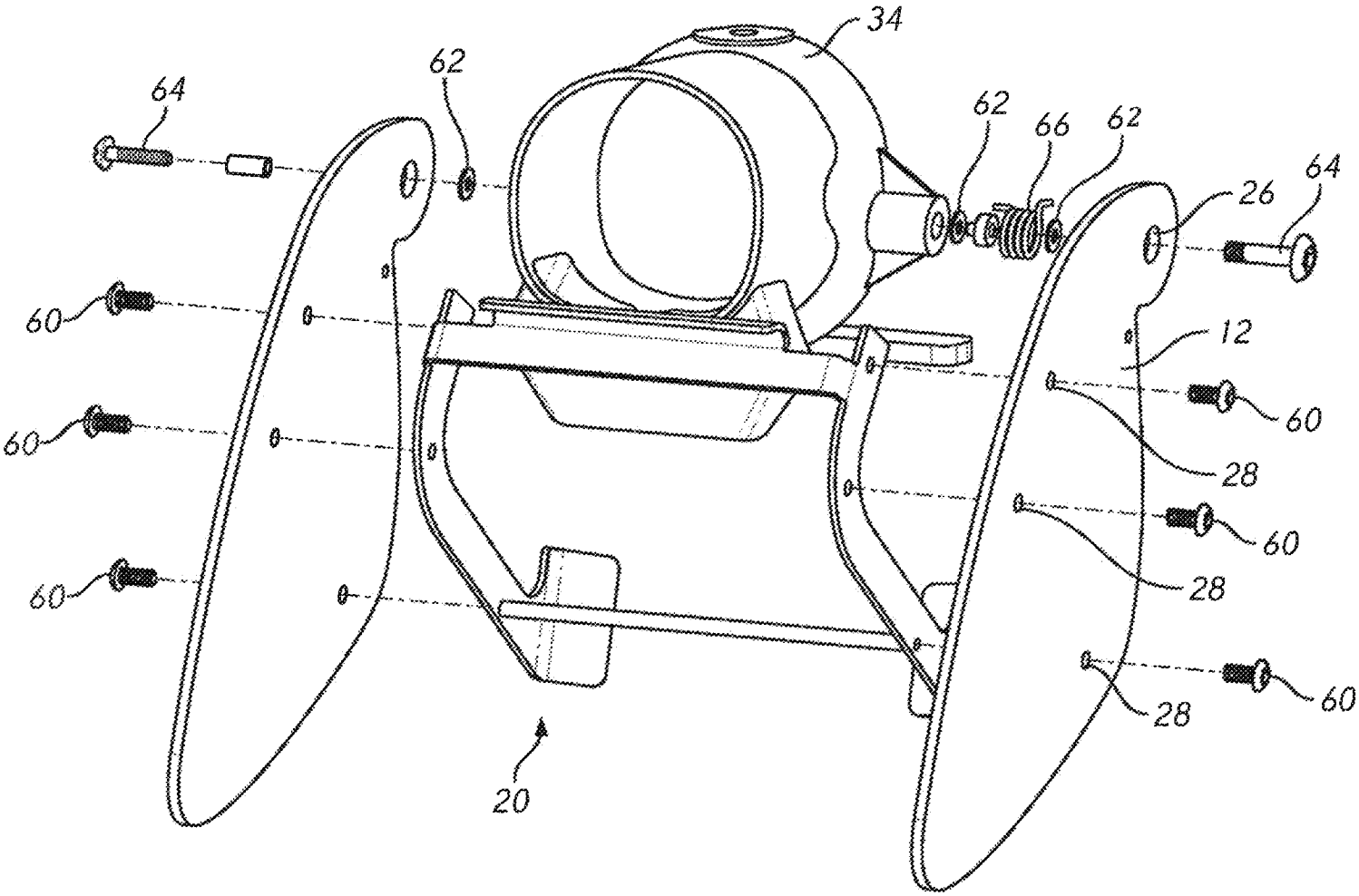
FIG. 9 is a perspective view, showing the present device and the way it attaches to a prior steerable nozzle.

An expanded view showing the attachment of device 10 to an existing steerable nozzle 34 is shown in FIG. 9. Reverse gate has been removed from the figure for illustrative purposes. However, if the steerable nozzle 34 included reverse gate, reverse gate would attach directly to the steerable nozzle 34, fitting between steerable nozzle 34 and blades 12 proximate attachment point 26. The reader will appreciate that any known method of connecting device 10 to a prior art steerable nozzle 34 can be used. For example, where steerable nozzle 34 does not include mount holes, device 10 may be coupled to a bracket which attaches to or fits around steerable nozzle 34. In the alternative, device 10 can be fully integrated with the existing watercraft 32, Thus, device 10 should not be limited to the present embodiment. The attachment of kickstand 30 is not shown in this figure.

Figure 2:
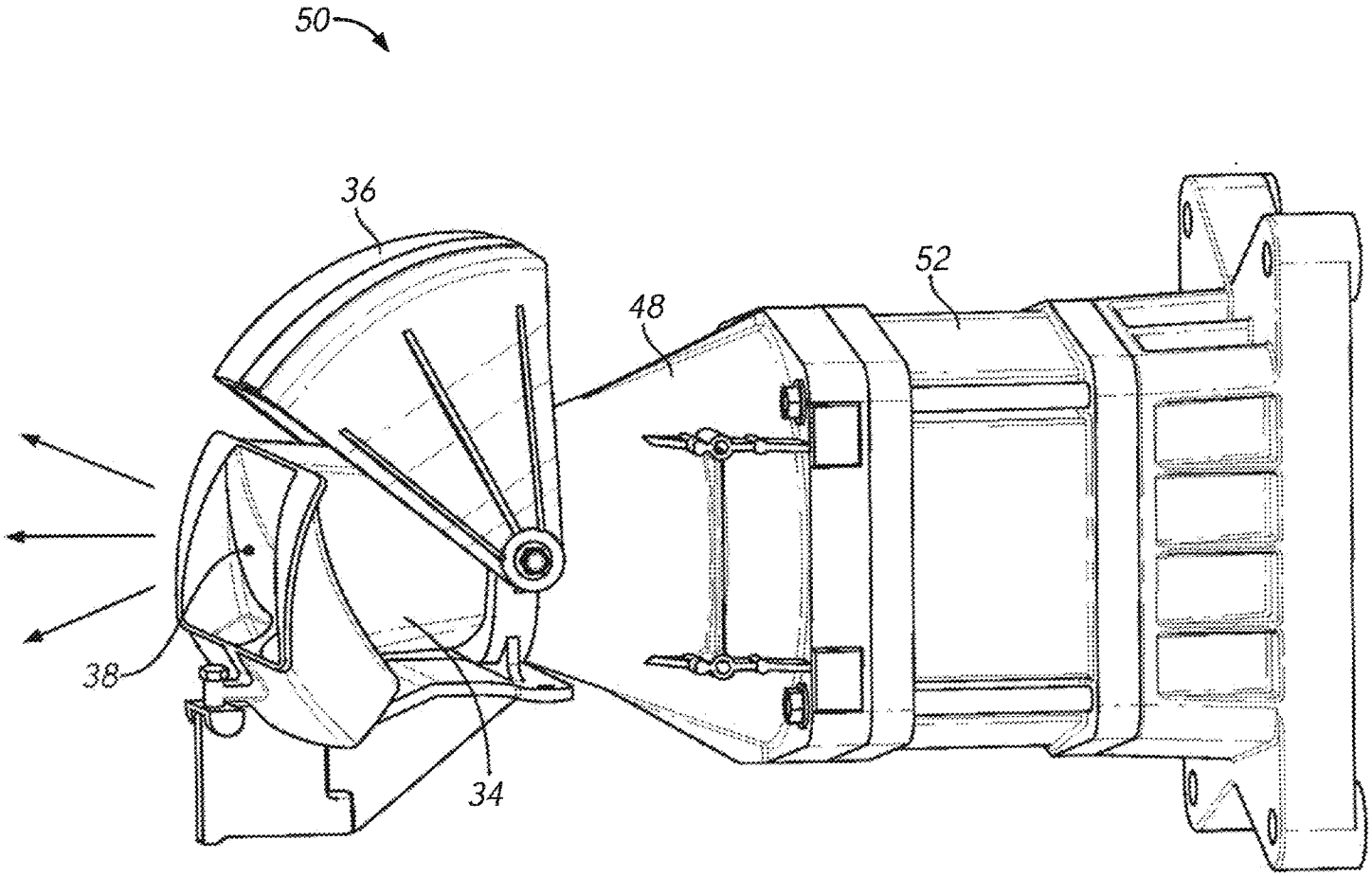
FIG. 2 (PRIOR ART)
FIG. 2 is a perspective view, showing a prior art jet propulsion system.
Figure 3:
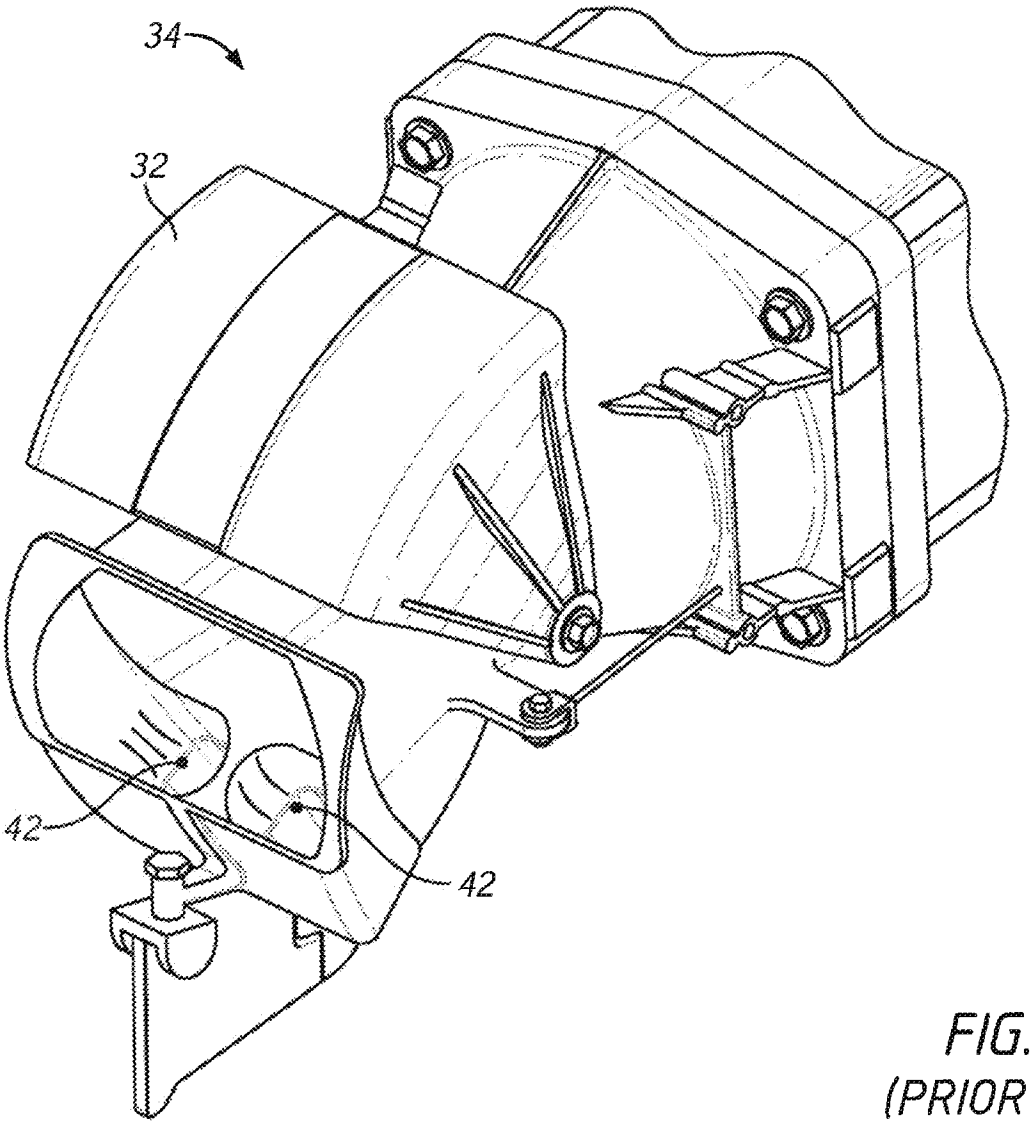
FIG. 3 (PRIOR ART)
FIG. 3 is a perspective view, showing a prior art tubular nozzle having a reverse gate.
Figure 4:
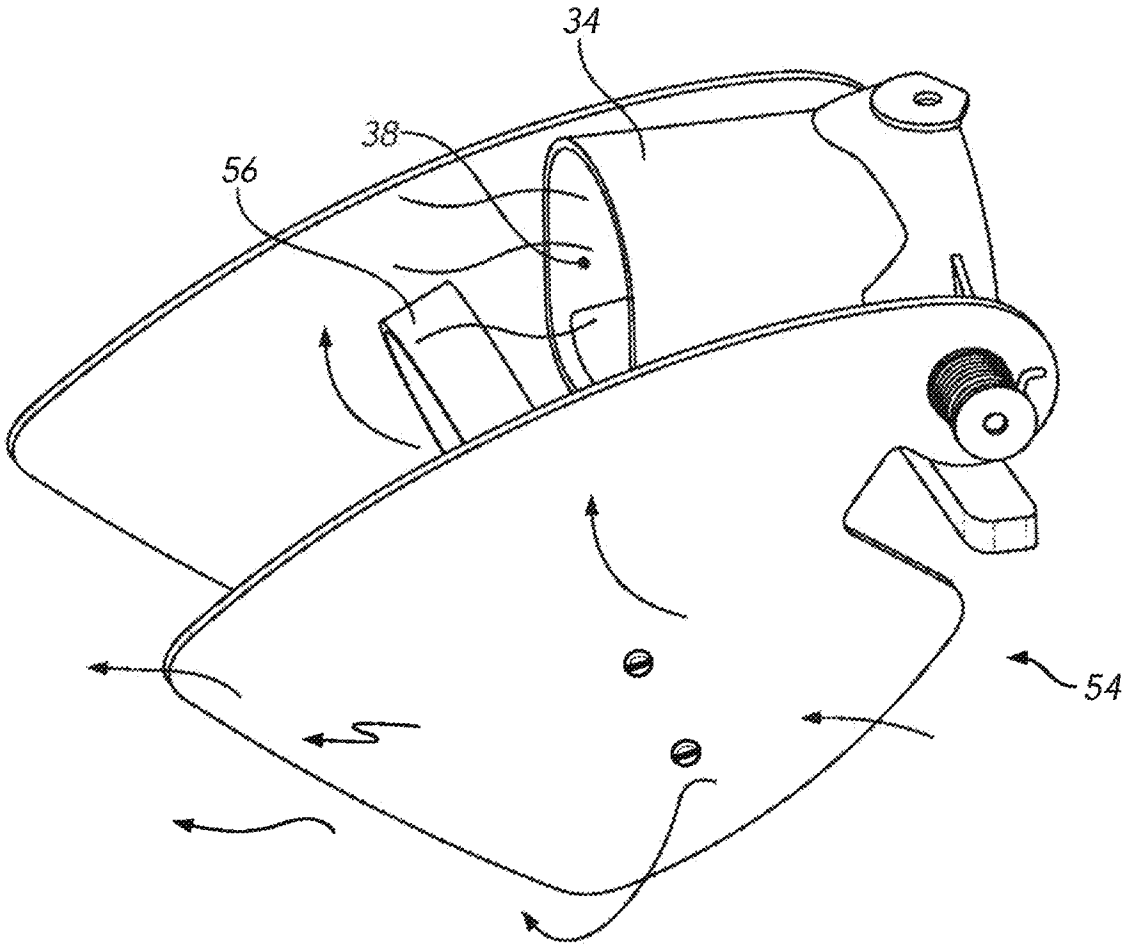
FIG. 4 (PRIOR ART)
FIG. 4 is a perspective view, showing a prior art rudder system.
Figure 5:
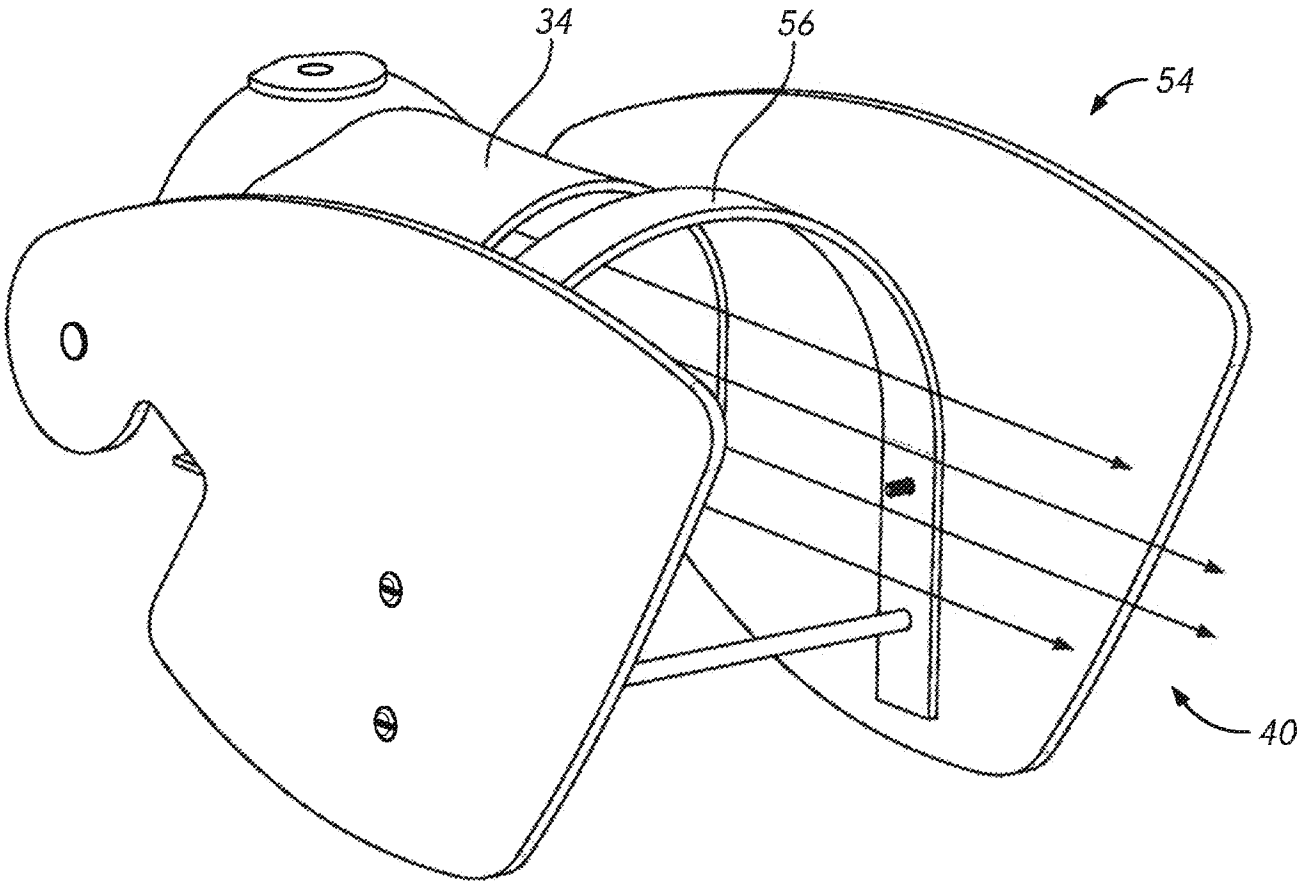
FIG. 5 (PRIOR ART)
FIG. 5 is a perspective view, showing a prior art rudder system lifting upward from the movement of water in the jet stream.

In FIG. 9 the broken lines represent the alignment of the prior art steerable nozzle 34 with the device 10. Steerable nozzle 34 includes at least two mount holes, which act as the pivot point about which reverse gate, as shown in FIG. 2, pivots (and attaches). Here, attachment point 26 on blades 12 fits into position beside mount holes on steerable nozzle 34. Washers 62 can be placed between mount holes on steerable nozzle 34 and attachment point 26 on blades 12. A threaded bolt 64 attaches blades 12 to steerable nozzle 12. In one embodiment a torsion spring 66 fits around threaded bolt 64 and hooks into blade 12. Spring tensioner 68 is applied by rotating spring around leading (forward) edge of steerable nozzle's steering arm. Blades 12 are attached to steerable nozzle 34 parallel to one another. The reader will appreciate that any known way of connecting steerable nozzle 34 to blades 12 (and therefore device 10) can be used.

Figure 10:
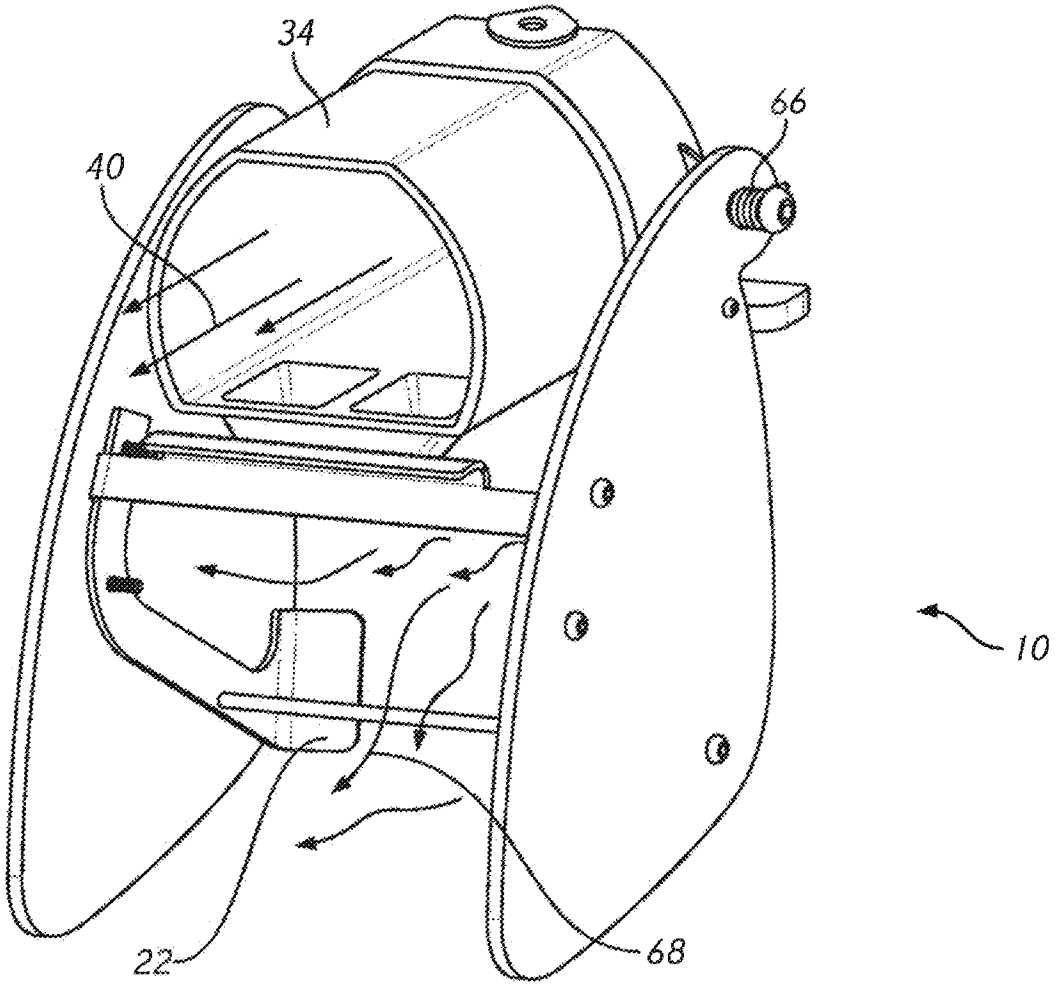
FIG. 10 is a perspective view, showing the present device attached to a prior art steerable nozzle with blades in a lowered position.
Figure 11:
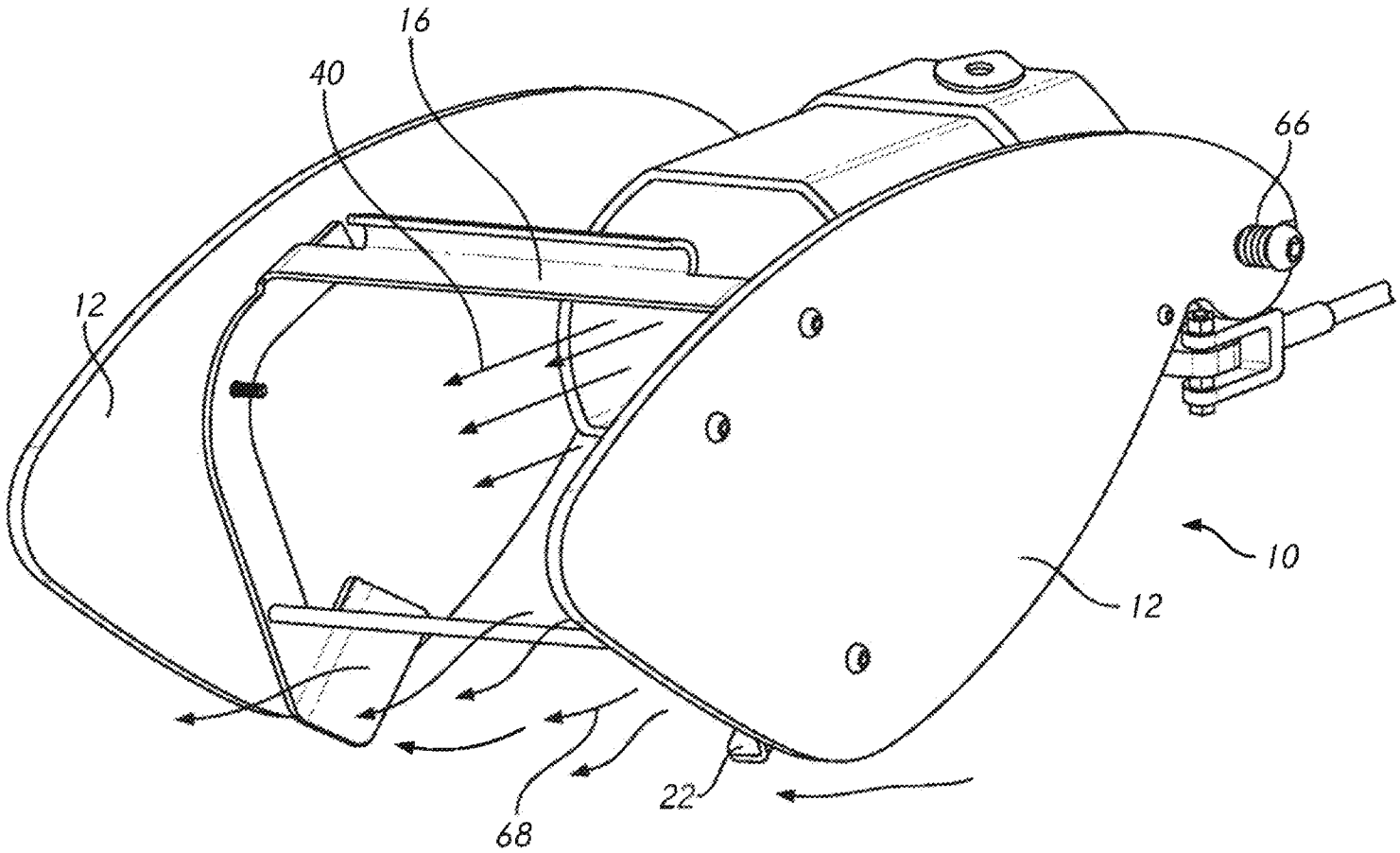
FIG. 11 is a perspective view, showing the present device attached to a prior art steerable nozzle with blades in a raised position.

FIGS. 10 and 11 show the flow of the water as it impacts device 10. For clarity, the reverse gate has been removed from the figure—however, if the nozzle included a reverse gate, reverse gate would attach directly to the steerable nozzle 34, fitting between steerable nozzle 34 and blades 12. In the lower position, as shown in FIG. 10, blades 12 are submerged in the water. This occurs when the watercraft is static or traveling at lower speeds. A torsion spring 66 can be used to provide a downward force that torsion spring exacts on blades 12. The torsion spring's downward force can be adjusted to increase or decrease the downward force. Exacted upon blades 12, which allows for tuning the desired speed at which the rudder system is permitted to rotate upward. At low speeds the blades 12 remain in the lowered position to add control to the steering of the watercraft. An optional kickstand 30 to hold blades 12 in a raised position when watercraft is anchored in shallow water is shown by reference numeral 30 in FIGS. 14-16. Down force regulator 14 is angled to allow the exiting jet stream 40 (shown in FIG. 10) from steerable nozzle 34 to assist the torsion spring 66 in holding device (blades) in the lowered position.

Device 10 is configured to minimize the interaction of device 10 with jet stream 40, Therefore, device 10 is primarily actuated by the general movement of the body of water beneath the boat. For purposes of this disclosure, "displaced water flow" will be known as all water flow that is not attributable to the jet stream. Displaced water flow 68 in FIGS. 10 and 11 is shown underneath the steerable nozzle 34. However, the reader will appreciate that as the lift tabs 22 are raised out of the water, in a raised "active" position (as shown in FIG. 11), displaced water flow 68 may be at the same level as, or at times higher than jet stream 40.

When watercraft reaches a speed where the upward force of the displaced water flow 68 on lift tabs 22 exceeds the downward force on the down force regulator 14 and the torsion spring 66, the device 10 begins to move upward and the down force regulator 14 enters the jet stream 40. Upon entering jet stream 40, the flat surface of the mount bracket connector 20, interacts with the jet stream 40 to move the device 10 upwards rapidly through and out of the jet stream 40. The blades 12 quickly and efficiently move into a raised or "active" position, as illustrated in FIG. 11.

Figure 12:
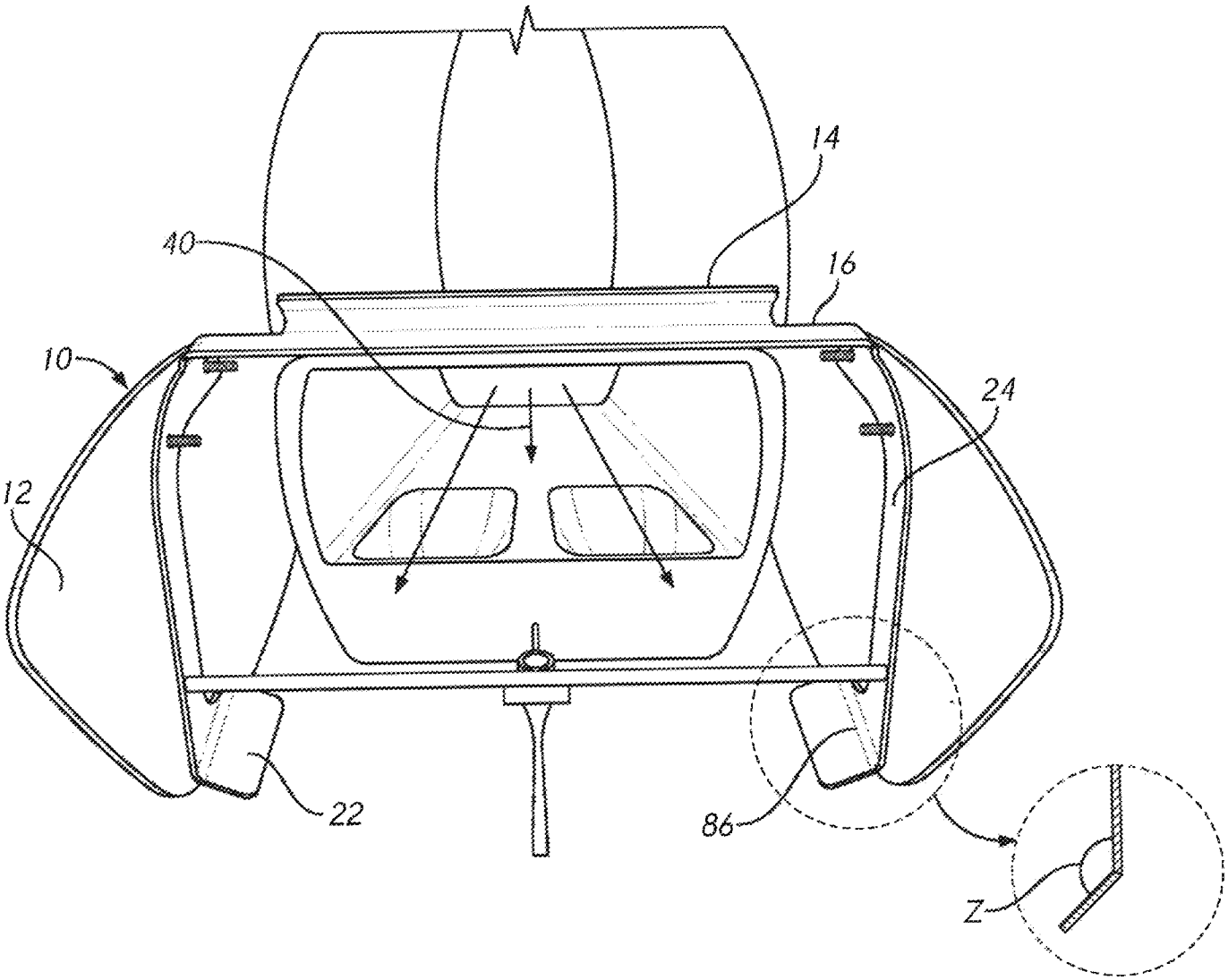
FIG. 12 is a perspective view, showing the present device attached to a prior art steerable nozzle with blades in a raised position.

Lift tabs 22 are positioned to deflect displaced water flow 68 downward, creating the upward force on the lift tabs 22 and therefore, device 10. As device 10 pivots upwards the position of lift tabs 22 shift with respect to the water, thereby naturally decreasing the water flow's angle of deflection (shown in FIG. 13 and further described below). The speed of the watercraft coupled with the angular deflection of water acting on lift tab 22, determines the upward force that causes lift tabs 22 to move upward through the body of water. As device 10 moves into a raised position mount bracket connector 16 moves quickly through jet stream 40, as previously discussed. However, once through jet stream 40, mount bracket connector 16 and down force regulator 14 remain clear of jet stream 40, as illustrated in FIGS. 11 and 12. Lift tabs 22 act to maintain device 10 in its raised position by riding along the surface of the water beneath the watercraft.

In its raised position, device 10 does not interact with jet stream 40 at all, as shown in FIG. 12. Lift tabs 22 raise mount bracket connector 16 well clear of jet stream 40 and are set apart by a distance that is wider than the width of the nozzle outlet 38. It is in this manner that device 10 avoids any interaction with jet stream 40 and thus does not cause unwanted spray.

Figure 13:
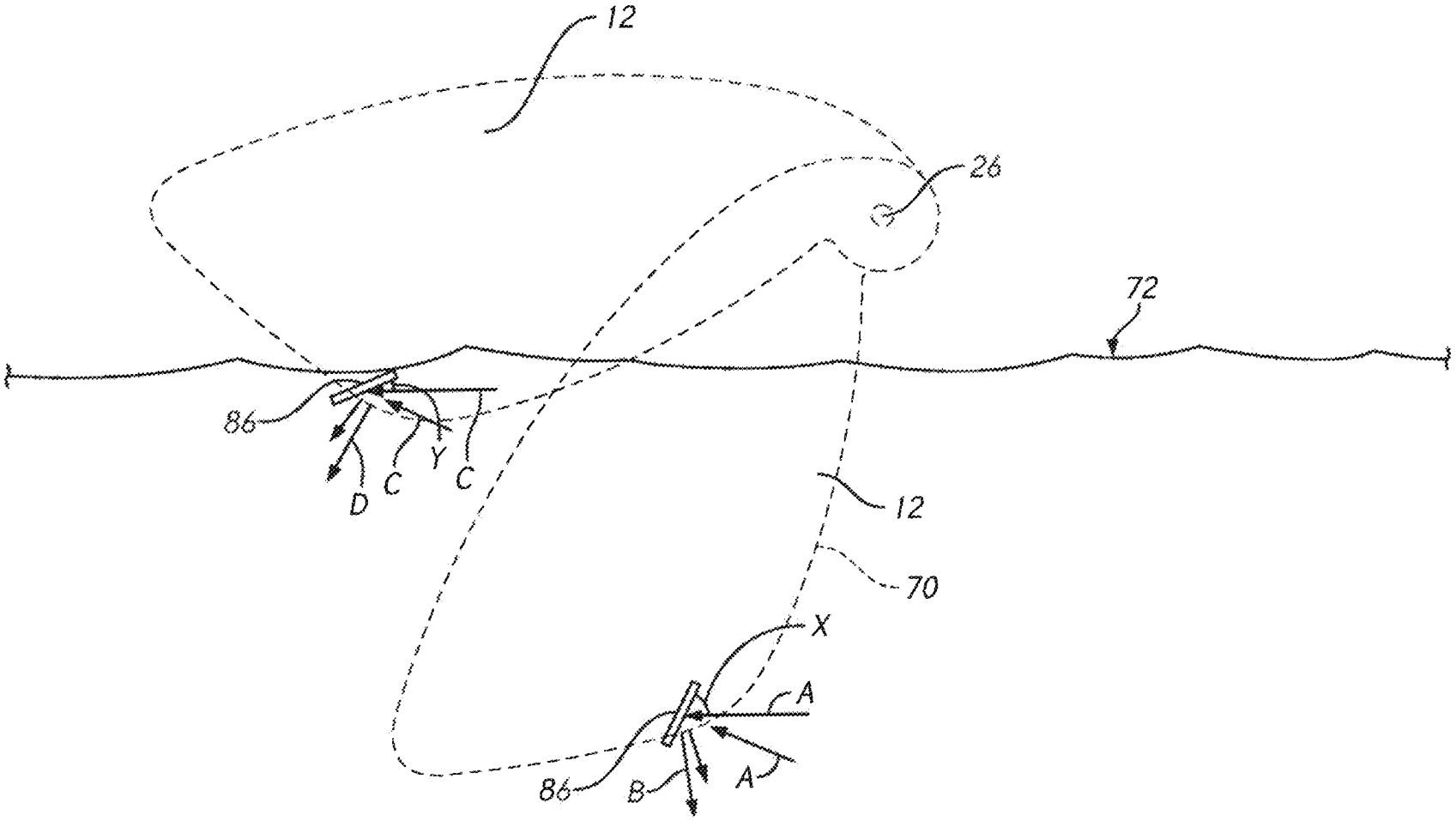
FIG. 13 is a schematic view, showing the angle of the lift tabs of the present device with respect to the blades (shown in broken lines for clarity), surface of the body of water and the force of displaced water flow around a watercraft.

FIG. 13 illustrates the angular position of lift tabs 12 in relation to blades 12. (shown in broken lines) and water flow as blades 12 pivot from a lowered position to a raised "active" position. First, lift tabs 12 meet mount brackets 24 along a crease 86 (or fold), as shown in FIG. 12. Crease 86 of lift tabs 12 are angularly positioned substantially parallel to the back edge 70 of blade 12, as shown in FIG. 13. In the lowered position, crease 86 of lift tabs 22 are angularly displaced from the surface of body of water 72 by greater than 45 degrees (represented by angle x). Additionally, as illustrated in FIG. 12, lift tabs 12 also are angularly displaced from the vertical plane of mount brackets by greater than 90 degrees. Therefore, in a lowered position, lift tabs 22 are configured to deflect water flow approximately 90 degrees or less, as shown by angle of displacement between A and B in FIG. 13 while simultaneously deflected water flow outward, away from the center of device 10 (away from jet stream 40). Lift tabs 12 are generally positioned on the interior wall (wall facing other blade 12) of blade 12 proximate the lower back edge 70 of blade 12 or the trailing curve of blade 12 (where blade 12 has a forward curve that is raised out of the water in the active position).

When blade 12 is in a raised "active" position, lift tab 22 is angularly displaced from the surface of body of water 72 by less than 45 degrees (represented by angle y). This positioning causes water flow to be redirected by approximately 90 degrees or more (angle of displacement between C and D), as the flow of water contacts lift tab 22. Additionally, due to its angular displacement shown by angle z in FIG. 12, water flow is also directed outward away from the center of device 10. In both positions, the speed of the watercraft moving through the body of water increases or decreases the force of the water flow on lift tabs 22, actuating device 10.

Figure 14:
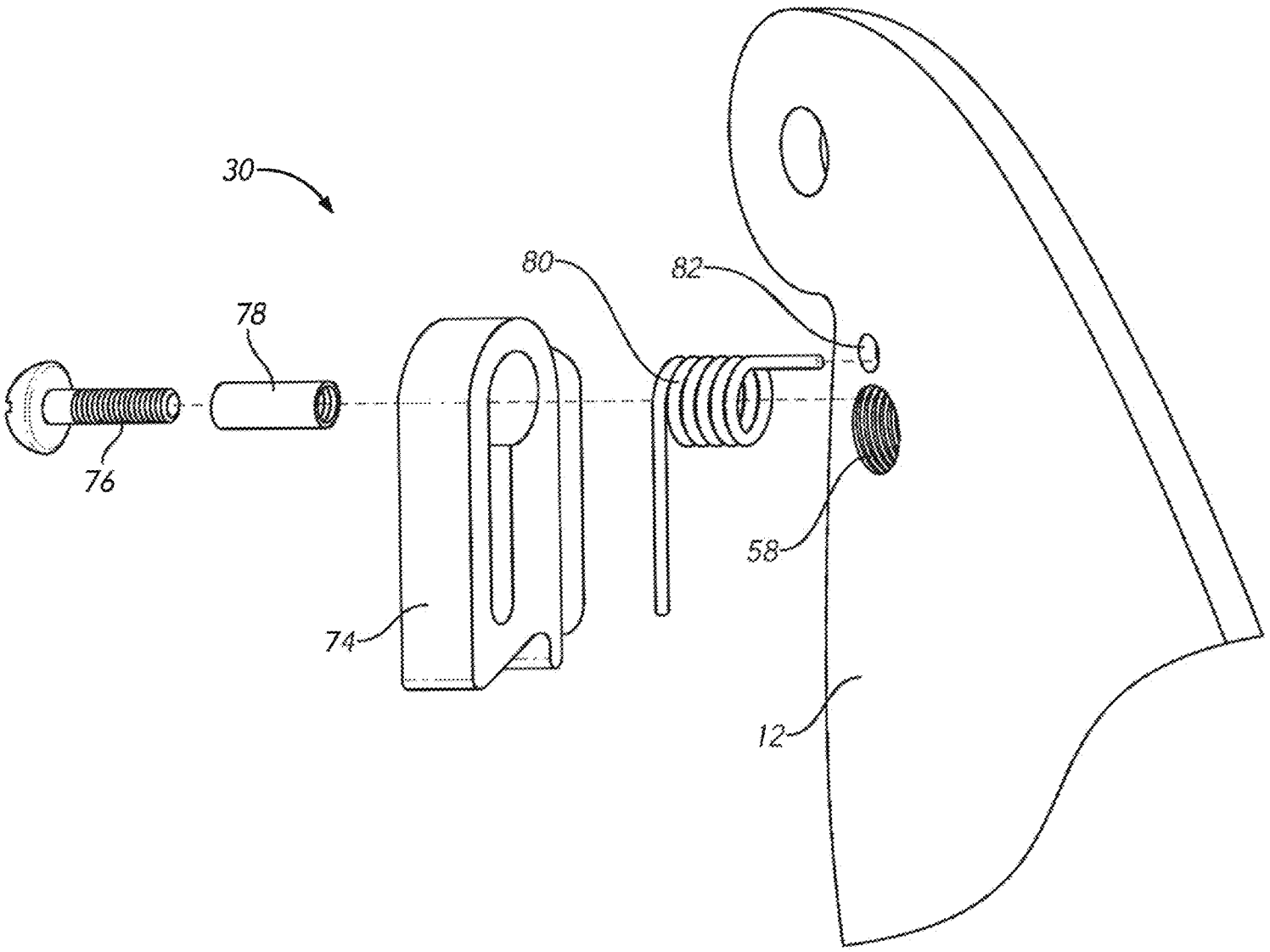
FIG. 14 is an exploded view, showing the way the kickstand attaches to the present device.

In one embodiment of device 10, device 10 includes a kickstand 30. Kickstand 30 is installed on device 10 by connecting to threaded hole 58 on blade 12. If threaded hole 58 is not threaded, a threaded fastener can be inserted to convert the hole into threaded hole 58. Kickstand 30 has a main body 74, spring 80, spacer 78 and screw 76. The end of torsion spring 80 pegs into spring hole 82, as depicted in FIG. 14, Main body 74 accepts the body and second end of torsion spring 80, such that as main body 74 pivots, torsion spring 80 exerts a torque in the opposite direction, proportional to the amount (angle) it is twisted. This acts to keep main body 74 in its disengaged position (fully rotated flush with blade 12). A spacer 78 and screw 76 act to secure kickstand main body 74 in a pivotal engagement with blade 12.

Figure 15:
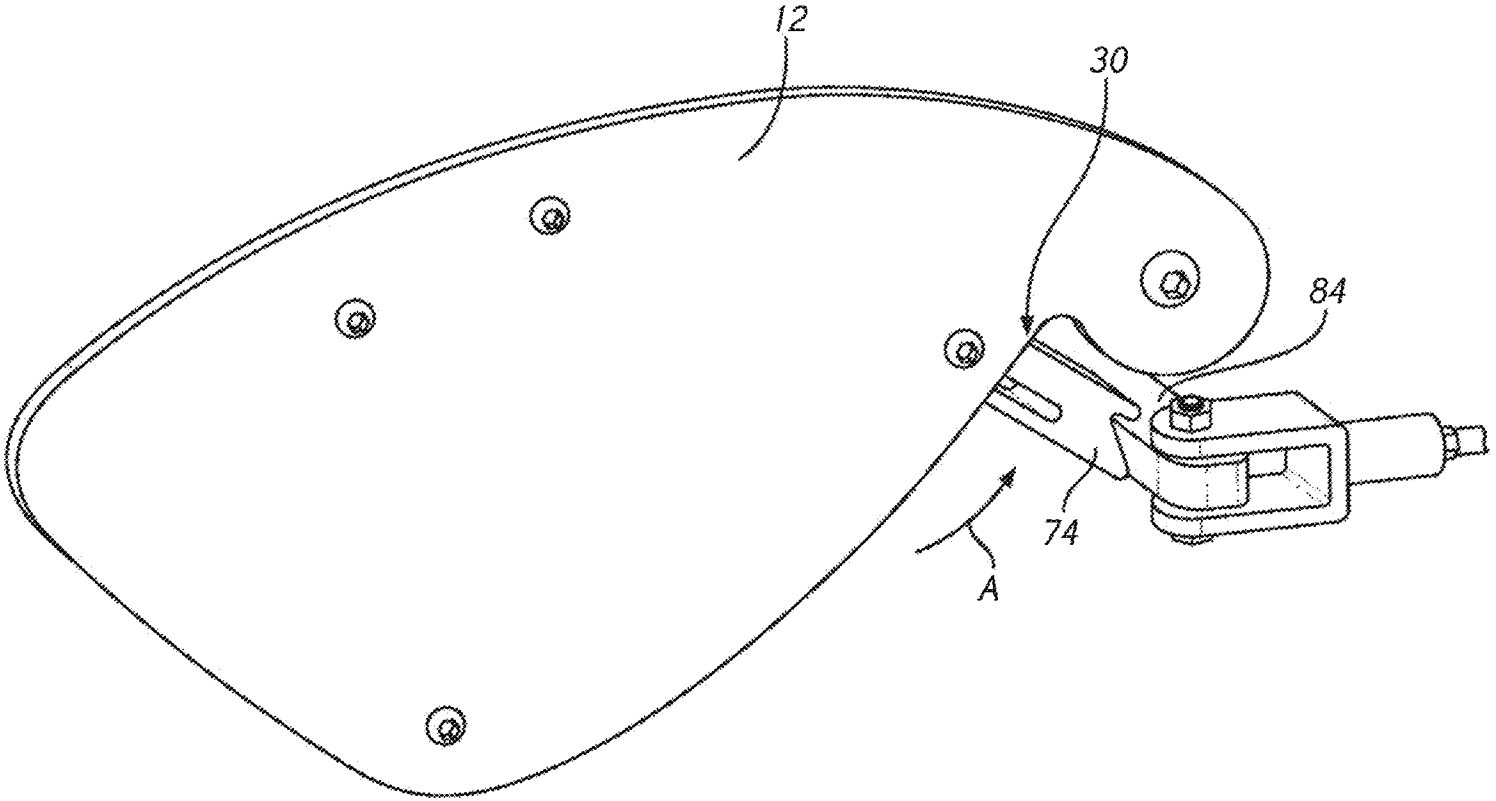
FIG. 15 is a perspective view, showing the kickstand component of the present device.

Kickstand 30 can be used to hold the blades 12 in a lifted position, as illustrated in FIG. 15. This may occur when a boater is concerned about blades 12 interacting with the ground. For example, a boater may want to raise the blades 12 when beaching a boat in a shallow water environment or when moving a boat on land in a steep driveway. To engage kickstand 30, a user lifts blades 12 and applies a rotational force to kickstand main body 74 in the direction shown by arrow A. Main body 74 is configured to accept prior art steering arm 84 which is integrated with prior art steerable nozzle. The user lowers the blades 12 and kickstand 30 holds device in place in the raised position (as shown in FIG. 15). The frictional engagement between kickstand 30 and prior art steering arm 84 is aided by the downward force of prior torsion spring 66 on blades 12 and the torque created by kickstand torsion spring 80.

Figure 16:
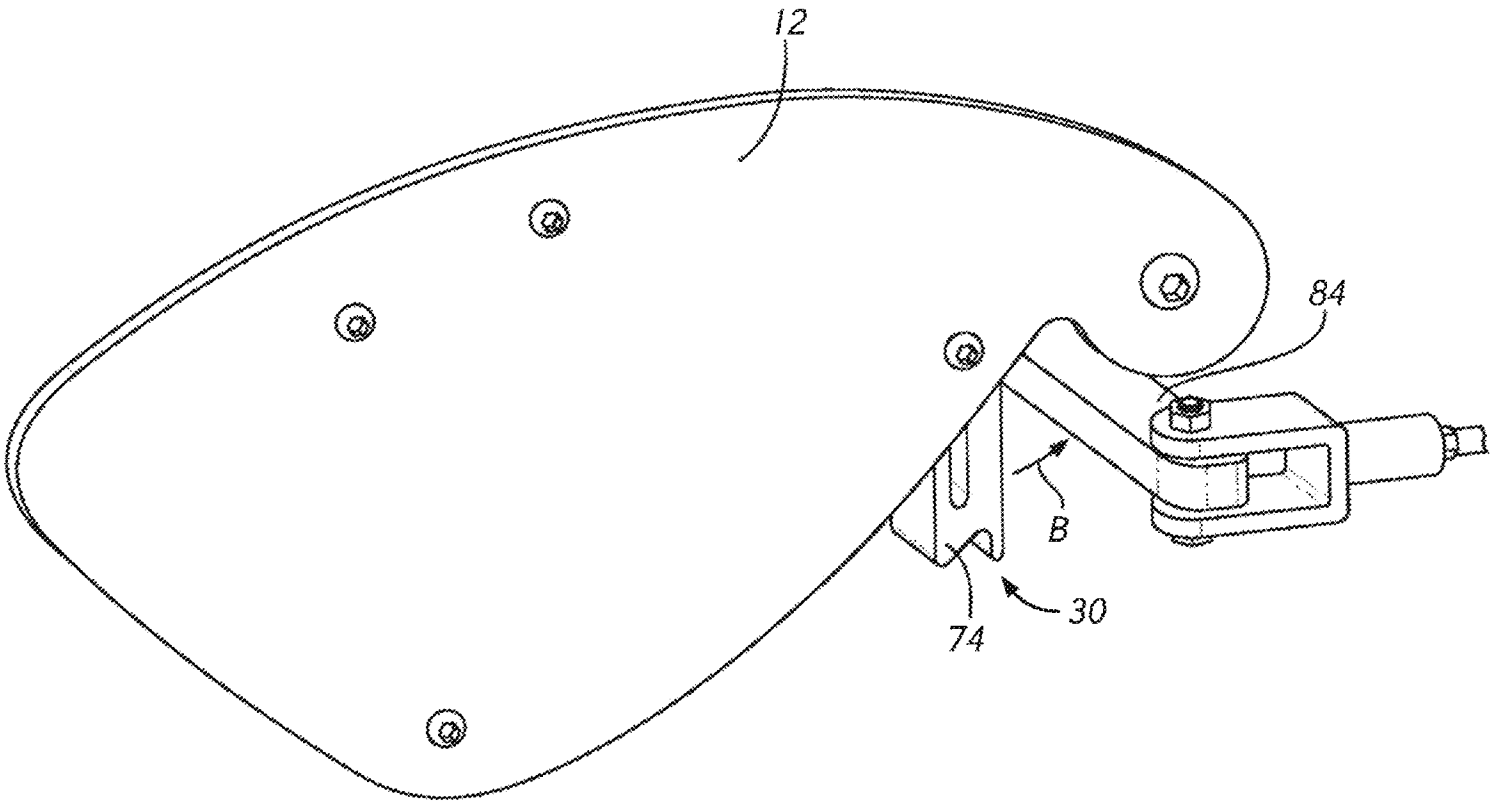
FIG. 16 is a perspective view, showing the kickstand component of the present device.

To release the kickstand 30, the user lifts the blades 12 slightly. The kickstand 30 springs back into place due to the force applied by torsion spring 80 on main body 74 of kickstand 30. FIG. 16 illustrates main body 74 of kickstand 30 as it rotates back into place. Arrow B illustrates the direction that kickstand 30 moves as it returns to a disengaged position. The reader will appreciate that in a disengaged position, main body 74 of kickstand 30 would not be visible in the view shown in FIGS. 15 and 16. Instead, main body 74 would be resting behind blade 12. If a user forgets to disengage kickstand 30, kickstand 30 will spring back into place when waterflow lifts blades 12.

The preceding description contains significant detail regarding the novel aspects of the present invention. It should not be construed, however, as limiting the scope of the invention but rather as providing illustrations of the preferred embodiments of the invention. As an example, device 10 can be fully integrated with rudder blades, watercraft and/or steerable nozzle 34. Therefore, the scope of the invention should be set by the scope of the claims.

Having described my invention, I claim:

1. A device for redirecting a jet stream flow created by a watercraft when traveling in a body of water, having a pump assembly, wherein said pump assembly a steerable nozzle, said device comprising:

a first rudder blade coupled to said steerable nozzle;

a second rudder blade coupled to said steerable nozzle; and a frame coupled to said first and second rudder blade, wherein said frame has:

a first mount bracket having a first and second end, a second mount bracket having a first and second end, a mount bracket connector connected to said first end of said first mount bracket and to said second end of said second mount bracket, a first lift tab attached to said second end of said first mount bracket, and a second lift tab attached to said second end of said second mount bracket; and wherein said frame is coupled to said first rudder blade and said second rudder blade.

2. The device as recited in claim 1, wherein said frame further comprises a down force regulator attached to said mount bracket connector.

3. The device as recited in claim 1, wherein said first and second rudder blades have a series of blade holes and said frame further comprises a series of mount holes, wherein a series of bolts are threaded through said series of blade holes and said series of mount holes to connect said frame to said first and second rudder blade.

4. The device as recited in claim 1, wherein said frame further comprises a cross tie.

5. The device as recited in claim 1, wherein said frame is one integral unit.

6. The device as recited in claim 2, wherein said down force regulator is angled such that said jet stream assists in holding said first and second rudder blades in a lowered position, submerged in said body of water.

7. The device as recited in claim 1, wherein as said watercraft moves through said body of water, an upward force acts on said first and second lift tabs such that said first and second blades pivot upward.

8. The device as recited in claim 1, wherein said mount brackets are substantially parallel to one another and form a C-shape.

9. A device for redirecting a jet stream flow created by a watercraft when in a body of water having a surface, wherein said watercraft also creates a displaced water flow and has a pump assembly, wherein said pump assembly has a deflector nozzle, wherein said deflector nozzle has a nozzle outlet, reverse gate pivotably connected to said nozzle, said device comprising:

a first and second rudder blade, pivotally attached to said deflector nozzle such that said first and second rudder blades are approximately parallel to one another, wherein said first and second rudder blades have a lower position and an active position, a mount bracket connector connected between said first and second rudder blade, a down force regulator formed as one integral unit with said mount bracket connector, a first lift tab connected proximate said lower back edge of said first rudder blade, a second lift tab connected proximate said lower back edge of said second rudder blade, and wherein said displaced water flow acts on said first and second lift tabs to create an upward force on said first and second lift tabs.

10. The device as recited in claim 9, wherein said device further comprises a cross tie having a first and second end, wherein said first end is connected to said first rudder blade and said second end is connected to said second rudder blade.

11. The device as recited in claim 9, further comprising a torsion spring attached to at least one rudder blade, wherein said torsion spring is capable of providing a downward force on said first rudder blade and said second rudder blade.

12. The device as recited in claim 11, wherein when said first rudder blade and said second rudder blade are in said lower position said jet stream creates a downward force on said down force regulator.

13. The device as recited in claim 12, wherein when said upward force on said first and second lift tabs exceeds said downward force on said down force regulator and said torsion spring, said first and second rudder blades move upward through said body of water, said down force regulator enters said jet stream and said mount bracket connector interacts with said jet stream to move said device upward rapidly through said jet stream.

14. The device as recited in claim 9, wherein when said first rudder blade and said second rudder blade are in said active position, said first lift tab and said second lift tab are configured to interact with said surface of said body of water, actively maintaining said first rudder blade and said second rudder blade out of said jet stream.

15. A device for redirecting a jet stream flow created by a watercraft when in a body of water having a surface, wherein said watercraft also creates a displaced water flow and has a pump assembly, wherein said pump assembly has a deflector nozzle, wherein said deflector nozzle has a nozzle outlet, reverse gate pivotably connected to said nozzle, said device comprising:

at least two rudder blades pivotally connected to said deflector nozzle, wherein said deflector nozzle has a torsion spring attached to at least one of said at least two rudder blades, a frame having:

at least two mount brackets each having a first end and a second end, a mount bracket connector attached to said first end of said at least two mount brackets, a down force regulator integrated with said mount bracket connector, and at least two lift tabs attached to said second end of said at least two mount brackets, wherein said frame is fixed between said at least two rudder blades, such said at least two rudder blades are parallel to one another, and wherein said jet stream flow creates a downward force on said down force regulator when said at least two rudder blades are in a lowered position.

16. The device as recited in claim 15, wherein in said lower position said at least two lift tabs are angularly displaced from said surface of said body of water by approximately 45 degrees, and wherein in said active position said at least two lift tabs are angularly displaced from said surface of said body of water by less than 45 degrees.

17. The device as recited in claim 15, wherein said displaced water flow acts on said at least two lift tabs to create an upward force on said at least two lift tabs.

18. The device as recited in claim 15, further comprising a torsion spring attached to at least one rudder blade, wherein said torsion spring is capable of providing a downward force on said at least two rudder blades.

19. The device as recited in claim 18, wherein when said at least two rudder blades are in said lower position said jet stream creates a downward force on said down force regulator.

20. The device as recited in claim 19, wherein when said upward force on said at least two lift tabs exceeds said downward force on said down force regulator and said torsion spring, said at least two rudder blades move upward through said body of water, said down force regulator enters said jet stream and said mount bracket connector interacts with said jet stream to move said device upward rapidly through said jet stream.

* * * * *